US005875984A

United States Patent [19]

Mack et al.

[11] Patent Number: 5,875,984

[45] Date of Patent: Mar. 2, 1999

[54] HANGER ASSEMBLY FOR ROVING BOBBINS AND CORE TUBES

[75] Inventors: Karl-Heinz Mack, Weilheim/Teck, Germany; Giovanni Patriarca, Capiago, Italy

[73] Assignee: Zinser Textilmaschinen GmbH, Ebersbach/Fils, Germany

[21] Appl. No.: 16,481

[22] Filed: Jan. 30, 1998

[30] Foreign Application Priority Data

Feb. 8, 1997 [DE] Germany ..... 197 04 758.0

[51] Int. Cl.[6] ..... B65H 49/02

[52] U.S. Cl. ..... 242/130.2; 242/486.8

[58] Field of Search ..... 242/130.2, 473.4, 242/474, 486.8, 571.3

[56] References Cited

U.S. PATENT DOCUMENTS

| | | | |
|---|---|---|---|
| 776,163 | 11/1904 | Allen | 242/571.3 |
| 2,919,079 | 12/1959 | Winslow | 242/130.2 |
| 3,367,098 | 2/1968 | Schulz | 242/130.2 X |
| 3,544,026 | 12/1970 | Bowie | 242/486.8 |
| 3,565,364 | 2/1971 | Numata | 242/130.2 |
| 4,919,363 | 4/1990 | Kitamura | 242/130.2 |
| 5,472,149 | 12/1995 | Bosch | 242/130.2 |

FOREIGN PATENT DOCUMENTS

| | | |
|---|---|---|
| 42 29 296 | 3/1994 | Germany . |
| 36 30 214 | 4/1994 | Germany . |

*Primary Examiner*—Michael Mansen
*Attorney, Agent, or Firm*—Herbert Dubno

[57] ABSTRACT

Improper actuation of a hanger for bobbins and bobbin core sleeves on a yarn-producing machine as a result of failure of the sleeve to seat properly at a spindle, is prevented by providing hangers with switching sleeves so that these can only be operated by a spindle shaft upon full insertion of the spindle into the roving sleeve.

9 Claims, 5 Drawing Sheets

FIG. 5
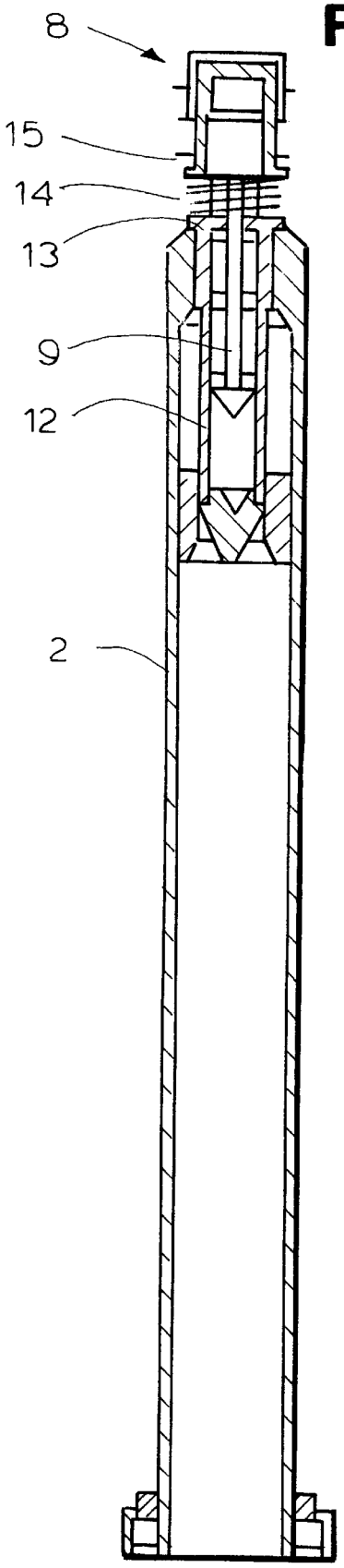
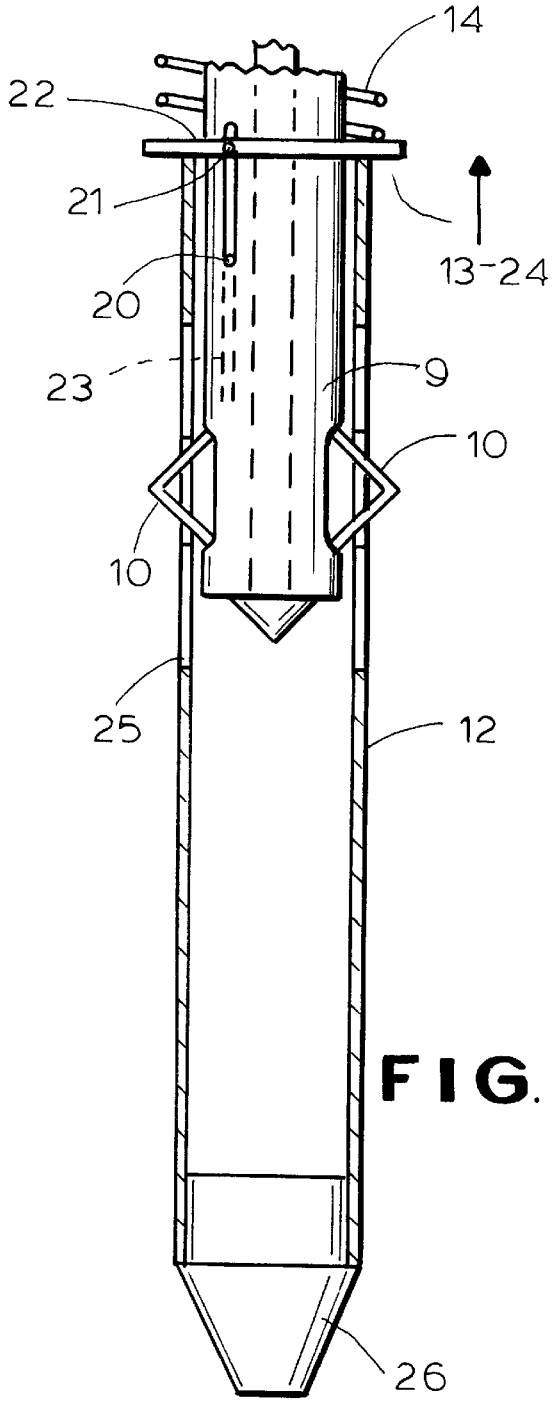
FIG. 6

HANGER ASSEMBLY FOR ROVING BOBBINS AND CORE TUBES

FIELD OF THE INVENTION

Our present invention relates to a hanger assembly for the core tubes of roving bobbins and, of course, fully wound bobbins on said core tubes. The invention more particularly, relates to a hanger assembly in which the hanger itself has a mechanism for engagement with and disengagement from a core tube upon axial displacement of the core tube.

The invention is intended primarily for systems in which the engagement and disengagement of the core tube by the hanger is automatic and, most desirably, in conjunction with an automatic bobbin change system.

BACKGROUND OF THE INVENTION

In the production of yarn, roving frames are used to transform sliver into roving which is wound on bobbins in roving frames. In a typical construction of such frames, two rows of spindles are provided on a vertically displaceable spindle rail and the spindles can be associated with flyers which receive drafted sliver downstream from a drafting frame and which serve to apply the roving to the bobbins.

The bobbins are wound on bobbin tubes, cores or core sleeves which, for that purpose, must be mounted on the spindle. It is a common practice to suspend the empty core tube from a hanger and to transfer the core tube from that hanger to the spindle, e.g. by a vertical movement of the spindle rail. Similarly, the full bobbin on the spindle may be transferred to a hanger by such a movement of the bobbin rail.

The hangers can be provided with latch or gripper mechanisms which engage in the upper ends of the empty core tubes or the fully-wound core tube, i.e. the core tube carrying the bobbin, and this mechanism may operate with an up and down movement of the core tube relative to the hanger to, for example, engage or latch the core tube in the hanger upon an initial upward movement and downward movement of the core tube and to release the core tube in another axial displacement of the core tube. The process is referred to as a change-over since it allows a core tube carried by a hanger to be seated on a spindle or a core tube carrying a full bobbin to be picked up from a spindle in the roving frame. Of course at a location outside the roving frame or outside the roving winding region, full bobbins are removed from hangers and these hangers may be supplied with empty core tubes.

There are mechanisms for automatically supplying the roving frame with empty core tubes and replacing fully-wound bobbins by such empty core tubes automatically (see DE 36 30 214 C). The core tubes fed to the hangers can be transferred to the spindles by raising the spindle rail and then lowering it. Similarly the full bobbins can be affixed on the hangers by raising the spindle rail, when the spindle carry such full bobbins, and then lowering it.

In the automatic transfer of empty roving core tubes to the bobbin carriers in the spindle rail of a roving frame, the hangers can be switched over by the upward movement of the core tubes.

During this process, the core tubes should have devices for entraining each core tube with the spindle in appropriate engagement. For this purpose, axially-extending teeth in a gear crown can be provided at the bottom of a core tube and can be interdigitated with a plurality of upstanding pins on the bobbin carrier.

The flanks of the pins and the teeth are so beveled that the two can interdigitate easily. In practice, however, this type of registry does not always occur and it is possible for the core sleeve to rest upon the tips of the pins and thus to seat somewhat higher, relative to the spindle, than is desirable during a changeover operation. In this case, with the axial movement of the core tube to release it from the latch of the hanger, the hanger disengages without full seating of the core tube on the spindle and the core tube can fall freely at least to a limited extent. When the fall is greater than the stroke required to latch or release the hanger, the core sleeve may be reengaged by the hanger and then not properly deposited on the spindle. The result is a failure in the changeover process and can lead to problems in machine operation and in the yarn-making process.

OBJECTS OF THE INVENTION

It is, therefore, the principal object of the present invention to provide an improved hanger assembly for core tubes and roving bobbins which can prevent the false relatching of a core tube and hence the drawback described above.

It is another object of the invention to provide a hanger assembly for roving bobbins and core tubes which is more reliable than earlier systems.

SUMMARY OF THE INVENTION

These objects and others which will become apparent hereinafter are attained, in accordance with the invention by providing a hanger assembly with a switching sleeve which can reach downwardly into the core tube into the position in which it is engaged by a spindle shaft extending upwardly from the bobbin carrier and thus so that the spindle of the bobbin carrier itself actuates the release mechanism. The release mechanism can thus be actuated whether or not the gear teeth and pins have fully seated always in the same relative positions of the spindle and hanger relatching of the core sleeve is thus precluded as is false release.

Hanger assembly for a roving frame, according to the invention, thus comprises:

- a roving frame spindle adapted to receive a core tube on which a roving bobbin is to be wound;
- a hanger juxtaposed with the spindle and provided with gripper means engageable in the core tube for positioning the core tube in alignment with the spindle, the gripper means including a mechanism switchable between core-tube engaging and core-tube releasing positions upon axial engagement of the core tube with the hanger; and
- means on the spindle for switching the mechanism at least from the core-tube engaging position to the core-tube releasing position.

The gripper means can include a housing and an axially shiftable member projecting beyond the housing into the core tube and engageable by the means on the spindle.

Preferably this member is a switching sleeve provided with a collar at an upper end thereof for engagement against an upper end of the core tube. A spring can be braced against a fixed shoulder of the hanger and the sleeve.

The collar can be located sufficiently high on the sleeve that it cannot be actuated by the sleeve before the spindle shaft effects the operation of the switching sleeve but can serve, when a spindle shaft is not involved, i.e. for latching of the hanger by hand or release of a core sleeve manually.

The relatively simple provision of a switching sleeve provides a low cost way of avoiding the failures described previously and which would otherwise require more expensive techniques in the case of a failure of the teeth at the bottom of the core sleeve to properly seat between the pins of the spindle.

BRIEF DESCRIPTION OF THE DRAWING

The above and other objects, features, and advantages will become more readily apparent from the following description, reference being made to the accompanying drawing in which:

FIG. 5 is a section showing a position in which the core tube is affixed to the hanger by a hand; and FIG. 6 is a cross section through the hanger drawn to a larger scale.

SPECIFIC DESCRIPTION

Figure 1:
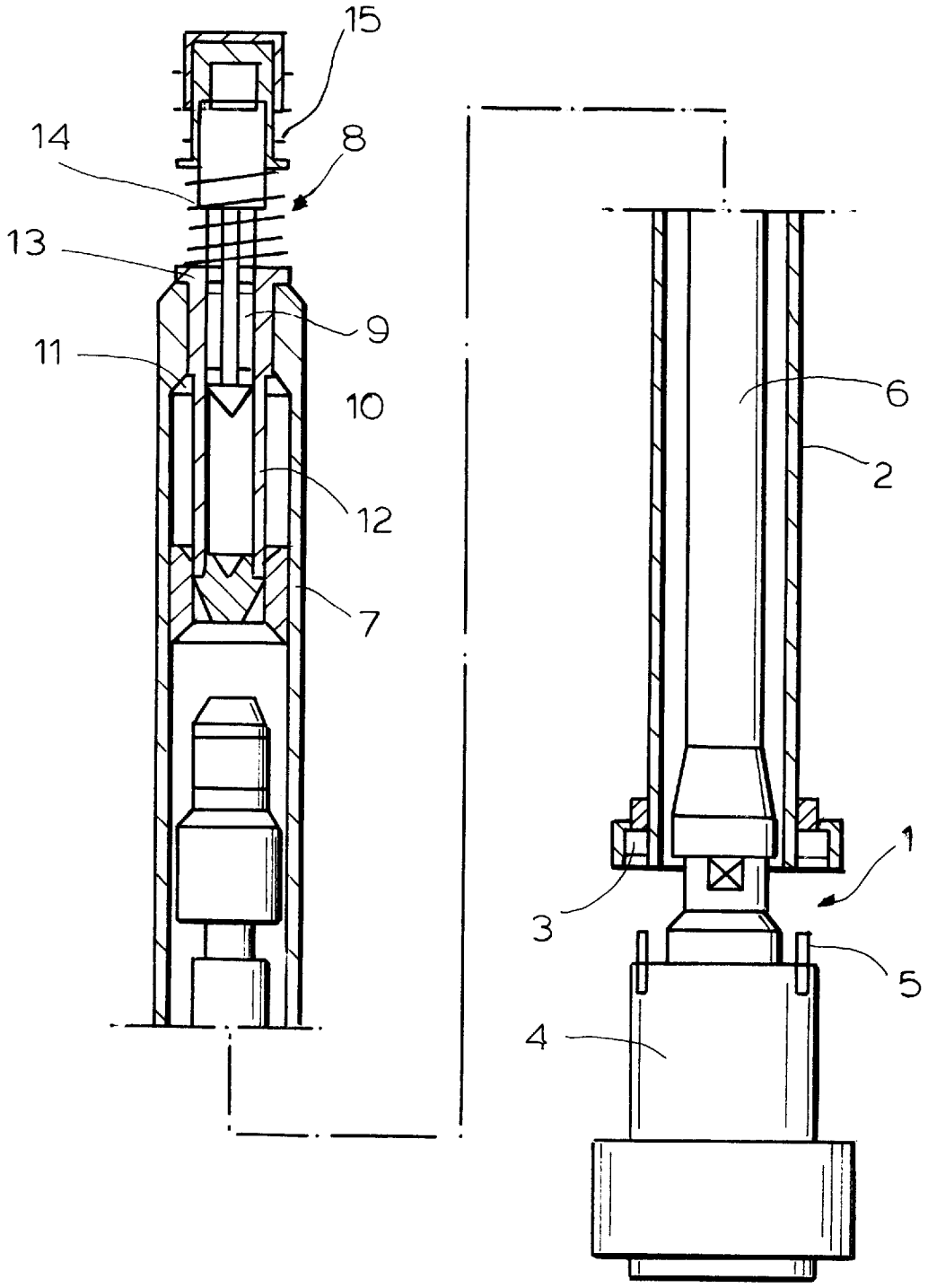
FIG. 1 is a cross sectional view showing the engagement of a core sleeve on the spindle of a roving machine in the position in which the core sleeve is still attached to the hanger and as not fully seated on the spindle.

The invention is particularly applicable to a roving frame of conventional design and in which there are two parallel rows of flyers and spindles, the empty core tubes on which the bobbins are to be wound, are supplied to the respective stations by hangers and generally on hanger carriages with trains of such carriages or the like, and can be stationed alongside the roving winding stations on tracks, preparatory to a transfer of the empty core tubes to the roving spindles and a transfer of fully-wound roving bobbins from the spindles to the hangers for transport of the full bobbins to ring spinning or other machines for further processing of the yarn. In the drawing, only a single spindle is shown and it will be understood that generally the spindles are arrayed along a spindle rail which is raised and lowered during the winding process to distribute the wound roving along the length of the core tube and hence of the bobbin as it is wound.

In addition, the rail is generally raised to latch the fully-wound bobbins onto the hangers and to engage the empty core tubes on respective hangers or to release the latches, thereby removing the tubes from the hangers and positioning them on the respective spindles. The spindle rail has also not been shown in the drawing.

An empty core tube for winding the roving bobbin has been shown at 2 and may be formed at its lower end with a crown of auxiliary directed teeth 3 which, upon full seating of the core tube upon the spindle 1 and particularly the bobbin carrier 4 thereof, interdigitate with pins 5 provided on the upper surface of the bobbin carrier. The interengagement of these pins with the teeth ensures entrainment of the core tube 2 and the bobbin wound thereon, as the core tube is rotated within the flyer.

Figure 2:
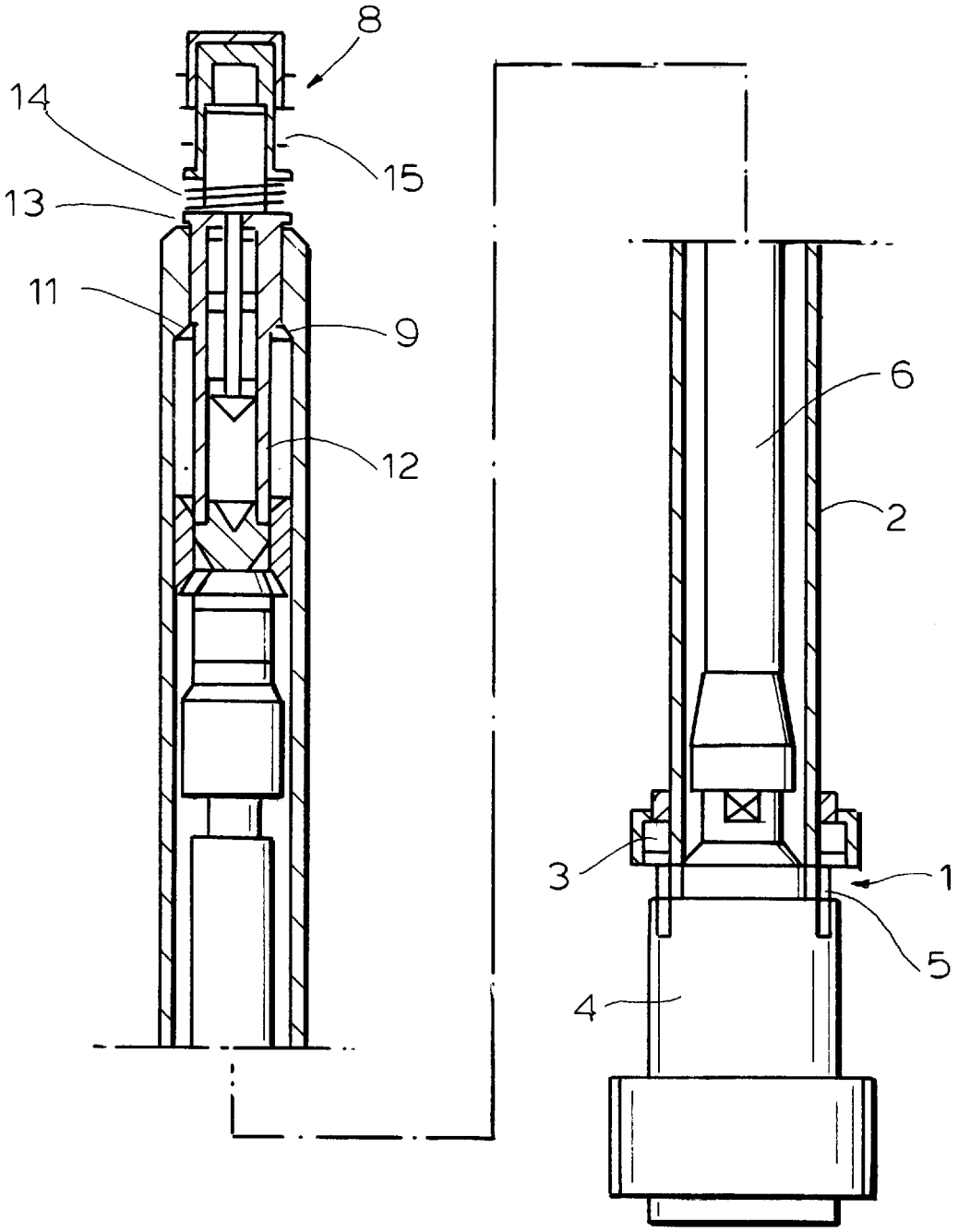
FIG. 2 is a view similar to FIG. 1 of the position in which the bobbin core rests upon the array of pins but wherein the teeth and pins have not been fully interdigitated and the hanger actuator of the spindle has engaged the additional sleeve of the hanger.
Figure 4:
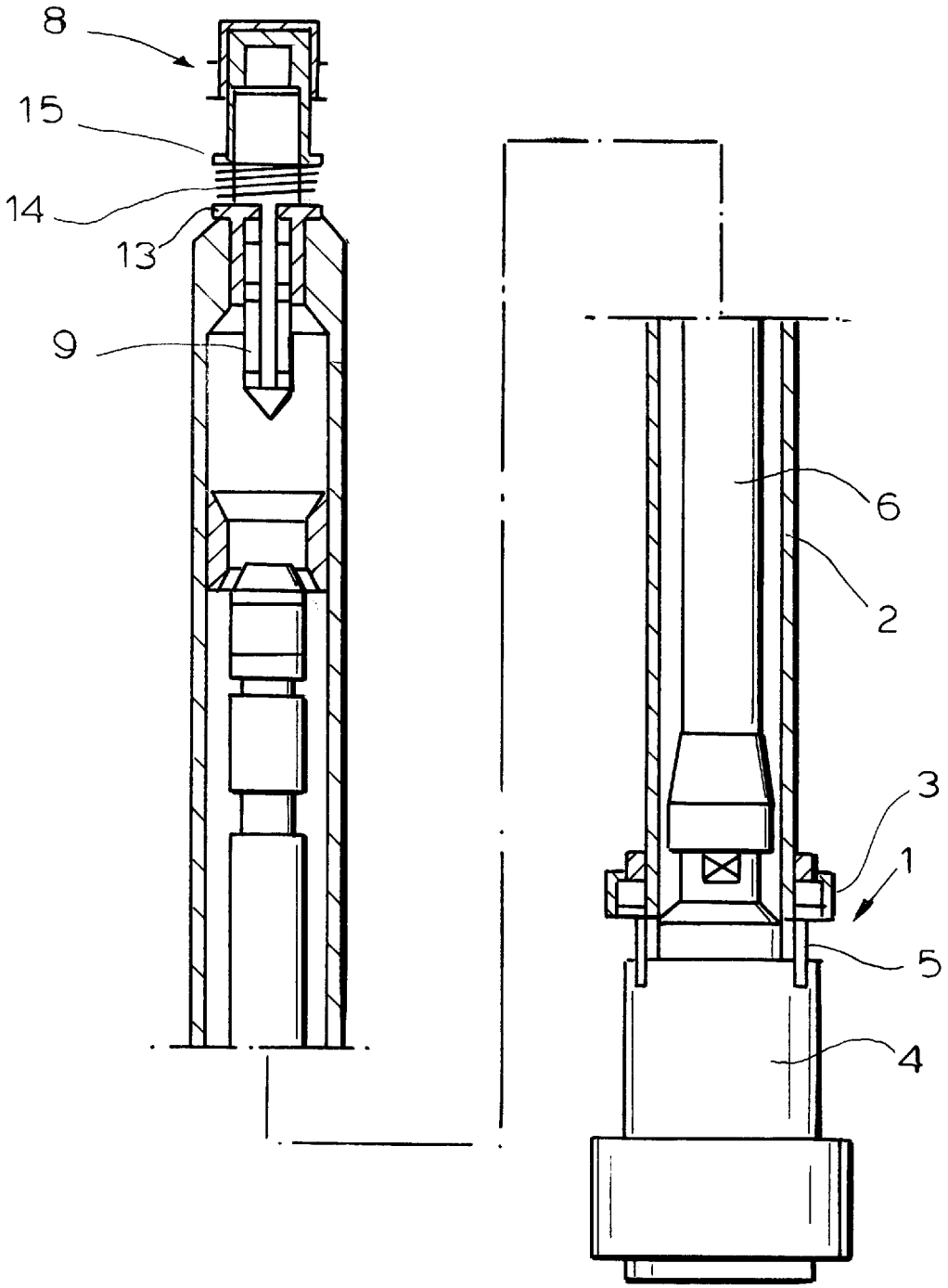
FIG. 4 is another similar view showing the position as might be the case with a prior art hanger in the case in which the teeth and entrainer pins are not engaged, i.e. a false release of the core tube.

It has already been noted that, in prior art systems, a problem can arise when, as shown in FIG. 2, for example, or FIG. 4, the core tube comes to rest upon the tops of the pins 5, i.e. the pins do not fully engage between the teeth or vice versa. This problem will be discussed again below.

In FIG. 1, we have shown a core tube 2 which is still firmly held in a hanger 8 and before that core tube is seated on the spindle. The spindle has been raised sufficiently for the actuator 6 to extend into the core tube.

As can be seen also from FIG. 6, each hanger 8 can comprise a substantially cylindrical housing 9 from which a pair of tongues 10 can project outwardly to engage the shoulder 11 of the interior of the core tube 2. Hangers of this type have a collar 13 which is coupled with the tongues 10 and which can retract the tongues 10 into the interior of the housing as this collar is axially shifted upwardly along the housing into its upper position relative to the housing. A spring 14 can bias the collar 13 into a lower position in which the tongues 10 project from the housing 9. The stroke of the collar 13 between its upper and lower positions and hence between the disengaged and engaged positions of the tongues can be about 5 mm.

The hanger 8, as has been indicated, forms part of a bobbin change or bobbin replacement apparatus not further illustrated. However, what is important is that the hanger 8 can be brought into alignment with a respective spindle 1 and thus can carry a bobbin core tube 2 into such alignment, it being assumed that the bobbin previously formed on this spindle 1 has been removed by the bobbin change mechanism.

The bobbin change mechanism can be of the type described in DE 36 30 214 C and can include, as here described, carriages displaceable along the roving frame and means for simultaneously placing a multiplicity of core tubes upon respective spindles. It can also be of the type described in DE 42 29 296 A1 in which a train of hanger carriages can be introduced into a row of flyers and in which each carriage can have a respective hanger 8.

According to the invention, on the housing 9 of each hanger 8, the actuating element in the form of sleeve 12 is provided and is axially shiftable. The switching sleeve 12 is so arranged and constructed that it can operate the mechanism for actuating the tongue or can operate the tongues 19 itself as shown in FIG. 6. In this construction the tongues 10 pass through windows in the actuating sleeve 12 so that, when the sleeve 12 is pressed upwardly relative to the housing 9, the collar is pressed upwardly and the tongues 10 are drawn inwardly and in either case are withdrawn from the shoulder 11 to release the grip of the hanger on the core tube.

In short, an upward movement of the switching sleeve 12 relative to the housing 9, actuates the mechanism for the tongues 10 and can release the core tube.

The switching sleeve 12 projects downwardly beyond the housing 9 sufficiently that the frustoconical formation 26 of the sleeve can be engaged by the spindle shaft or actuator 6 which has an upper end juxtaposed with the lower frustoconical end of the actuator sleeve 12 that it can be engaged by the actuator sleeve once the core tube 2 is fully seated on the spindle. The actuator can extend up into the guide bush 7. This upward movement releases the engagement of the hanger with the core tube. The actuator 6 is so positioned that it cannot disengage the hanger from the core tube until the teeth 3 are fully engaged between the pins 5 and vice versa.

Figure 3:
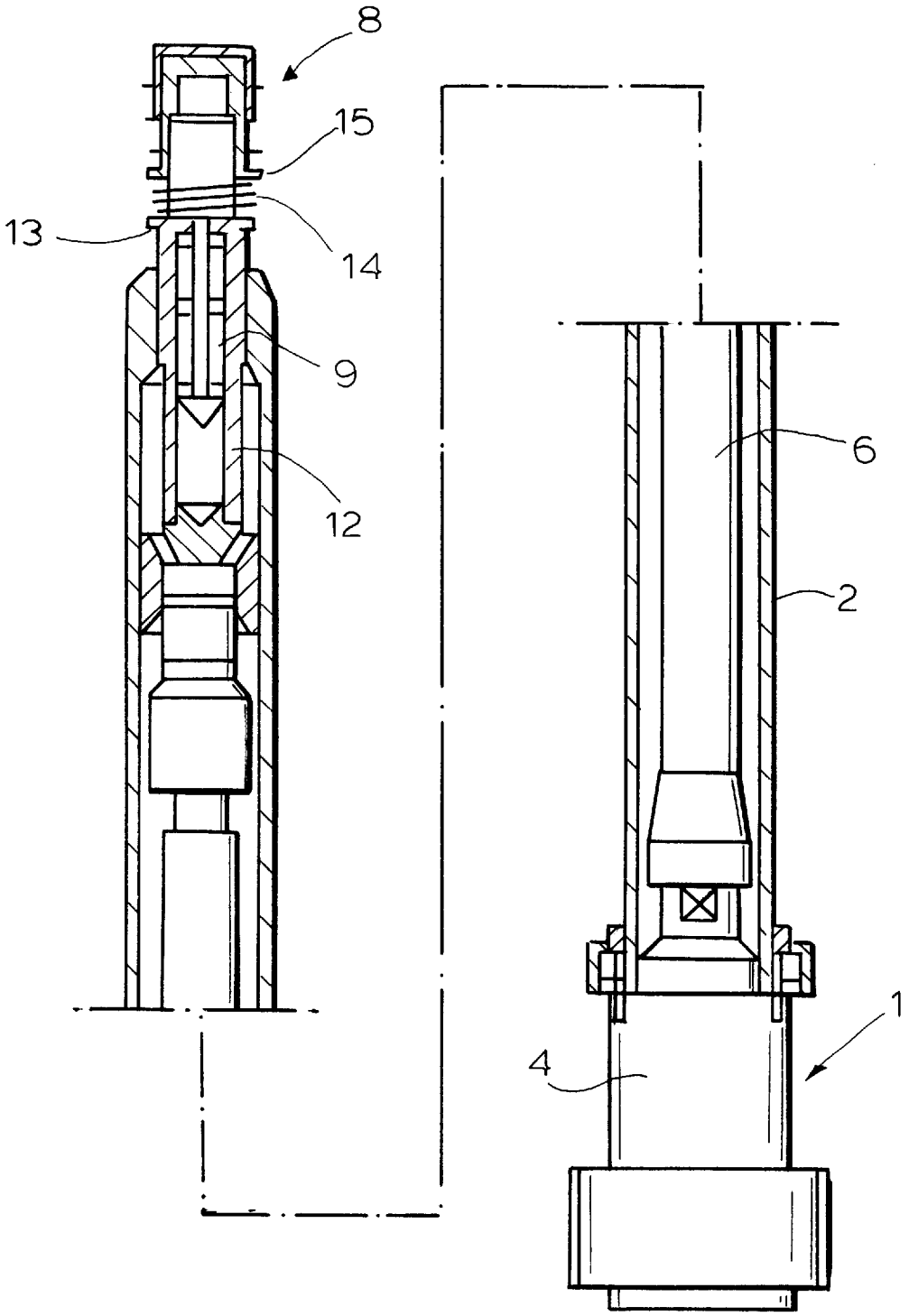
FIG. 3 is another view similar to FIG. 1 but illustrating the position in which the hanger has been released from the core tube by the actuator and the core tube has its teeth interdigitated with the entrainer pins of the spindle.

When the teeth rest upon the pins 5 as shown in FIGS. 2 and 4, the actuator 6 cannot engage the sleeve 12 and the tongues 10 will not be released. Only upon the further displacement of the core tube onto the spindle with such full engagement of the teeth and pins (FIG. 3) is the sleeve 12 raised.

In the absence of the sleeve 12 (FIG. 4), the drop of the core tube through the height of the teeth and pins upon release of the tongues 10 at the hanger can result in renewed engagement of the tongues with the core sleeve and a lack of disengagement during the bobbin change operation. Core tubes can be retained improperly on their hangers and normal operation of the machine can be interrupted.

However, when the switching sleeve 12 is additionally provided on each hanger, the release is switched not by the movement of the collar 13 by the core sleeve, but rather by actuation of the switching sleeve 12 by the end of the spindle shaft 6. In this case it makes no difference whether the core tube is fully seated on the pins 5 or not, since the core tube will remain on the spindle and be disengaged by the hanger 8. Since the hangers 8 can be released solely by the spindle shafts 6 independently from the operation of the collar 13, the system of the invention enables a core tube 2 or a full bobbin (see FIG. 5) to be affixed to the hanger 8 or to be removed therefrom by hand. In this case, the collar 13 is provided so that it can be used to effect the release by an upward movement of the collar. When the spindle shaft 6 is used exclusively to control the hanger, of course the collar 13 is provided, as is preferably the case, it is arranged sufficiently high relative to the switching sleeve 12 that it is not actuated by the core tube 2 and is not reached by the latter when the core tube 2 rests on top of the pins 5, before changeover is effected by means of the spindle 6.

To prevent an undesired actuation of the hanger 8 by a core tube 2 on its insertion or by a tilting of the switching sleeve 12, the switching sleeve 12 can be braced via the collar 13 by means of a spring 14 seated against a fixed shoulder 15 of the hanger.

For example, the collar 13 can be connected to a rod 20 by a pin 21 guided in a slot 22 of the housing 9 and that rod 20 can be pivotally connected at 23 to the bent tongue 10. When the collar 13 or the sleeve 12 is moved relative to the housing 9 in the direction of arrow 24, the tongue is pulled into the housing 10. When that collar and the sleeve 12 move into the opposite direction, e.g. under spring 14, the spring projects through a window 25 in the sleeve 12 to engage the shoulder 11. A similar mechanism can be provided for the other tongue.

We claim:

1. A hanger assembly for a roving frame, comprising:

a roving frame spindle adapted to receive a core tube on which a roving bobbin is to be wound;

a hanger juxtaposed with said spindle and provided with gripper means engageable in said core tube for positioning said core tube in alignment with said spindle, said gripper means including a mechanism switchable between core-tube engaging and core-tube releasing positions upon axial engagement of said core tube with said hanger; and means on said spindle for switching said mechanism at least from said core-tube engaging position to said core-tube releasing position.

2. The hanger assembly defined in claim 1 wherein said gripper means includes a housing and an axially shiftable member projecting beyond said housing into said core tube and engageable by said means on said spindle.

3. The hanger assembly defined in claim 2 wherein said member is provided with a collar at an upper end thereof for engagement against an upper end of said core tube.

4. The hanger assembly defined in claim 2, further comprising a spring braced against a fixed shoulder of said hanger and against said axially shiftable member.

5. The hanger assembly defined in claim 2 wherein said axially shiftable member is a switching sleeve axially shiftable on said housing and provided with a frustoconical formation at a lower end of said sleeve receivable in a guide bushing in said core tube, said means on said spindle being an axially-extending spindle shaft reaching upwardly from said spindle into said core tube and engageable with said frustoconical formation.

6. The hanger assembly defined in claim 5 wherein said sleeve is formed at an upper end thereof with a collar engageable with an upper end of said core tube.

7. The hanger assembly defined in claim 6 wherein said mechanism includes at least one tongue received in said housing and displaceable into and outwardly from said housing, said core tube being provided with a shoulder engageable by said tongue.

8. The hanger assembly defined in claim 7 wherein said housing extends upwardly beyond said core tube, further comprising a coil spring surrounding said housing above said collar and braced between a fixed shoulder and said collar.

9. The hanger assembly defined in claim 8 wherein said spindle is formed with a bobbin carrier provided with an array of pins and said core tube is formed on a lower end with a crown of axial teeth adapted to interdigitate with said pins.

* * * * *